United States Patent [19]

Robinson

[11] 4,185,437

[45] Jan. 29, 1980

[54] BUILDING WALL PANEL AND METHOD OF MAKING SAME

[75] Inventor: Ralph C. Robinson, Redmond, Wash.

[73] Assignee: Olympian Stone Company, Redmond, Wash.

[21] Appl. No.: 949,696

[22] Filed: Oct. 10, 1978

[51] Int. Cl.[2] ..... E04C 2/02

[52] U.S. Cl. ..... 52/601; 264/256

[58] Field of Search ..... 52/600, 601, 309.13, 52/309.16, 309.17, 351, 483, 475, 481, 309.3, 309.11, 309.9, 335, 340, 341, 630, 821, 827, 828, 829, 406, 407, 327, 344

[56] References Cited

U.S. PATENT DOCUMENTS

| | | | |
|---|---|---|---|
| 2,241,338 | 5/1941 | Balduf . | |
| 2,369,595 | 2/1945 | Miles | 52/483 |
| 2,409,212 | 10/1946 | Kautz | 52/828 |
| 2,934,934 | 5/1960 | Berliner . | |
| 3,094,813 | 6/1963 | Saxe . | |
| 3,466,825 | 9/1969 | Guddal . | |
| 3,885,008 | 5/1975 | Martin . | |
| 4,019,297 | 4/1977 | Murphy . | |

*Primary Examiner*—John E. Murtagh

*Attorney, Agent, or Firm*—Graybeal & Uhlir

[57] ABSTRACT

A building wall panel having an exterior facing formed from a glass fiber reinforced concrete bonded to a metal wall panel support frame formed from a plurality of vertical members having a plurality of flanges thereon by a layer of glass fiber reinforced concrete overlaying both a portion of the rear surface of the exterior facing and the flange abutting the exterior facing at intervals along the length of each vertical member. A method of forming the building wall panel involves spraying a first layer of slurry, formed from a mixture of concrete and chopped glass fiber strands, on a flat smooth surface between elongate members secured thereto and interconnected to form building wall panel mold. A metal wall panel support frame formed from a plurality of vertical members is placed over the first layer of slurry such that a flange disposed on each vertical member abuts the first layer of slurry. A second layer of slurry is sprayed over a portion of the flange on each vertical member and over a portion of the first layer of slurry. Both layers of slurry are cured and the completed building wall panel is removed from the surface and the mold.

15 Claims, 10 Drawing Figures

Fig. 1
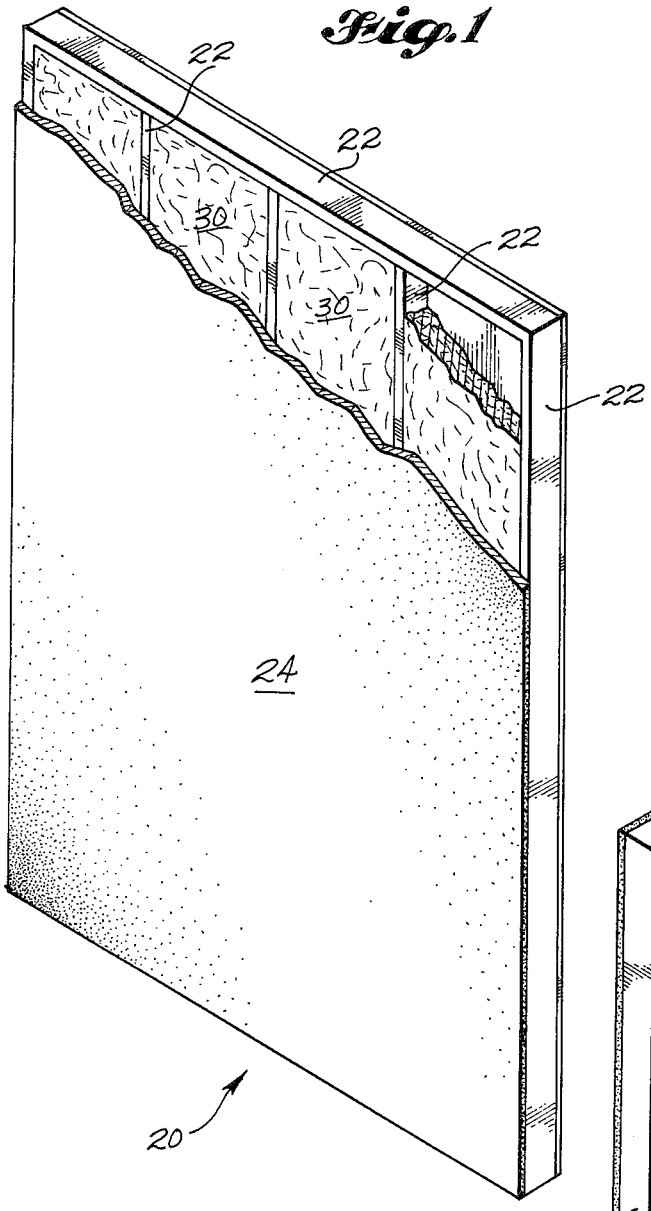
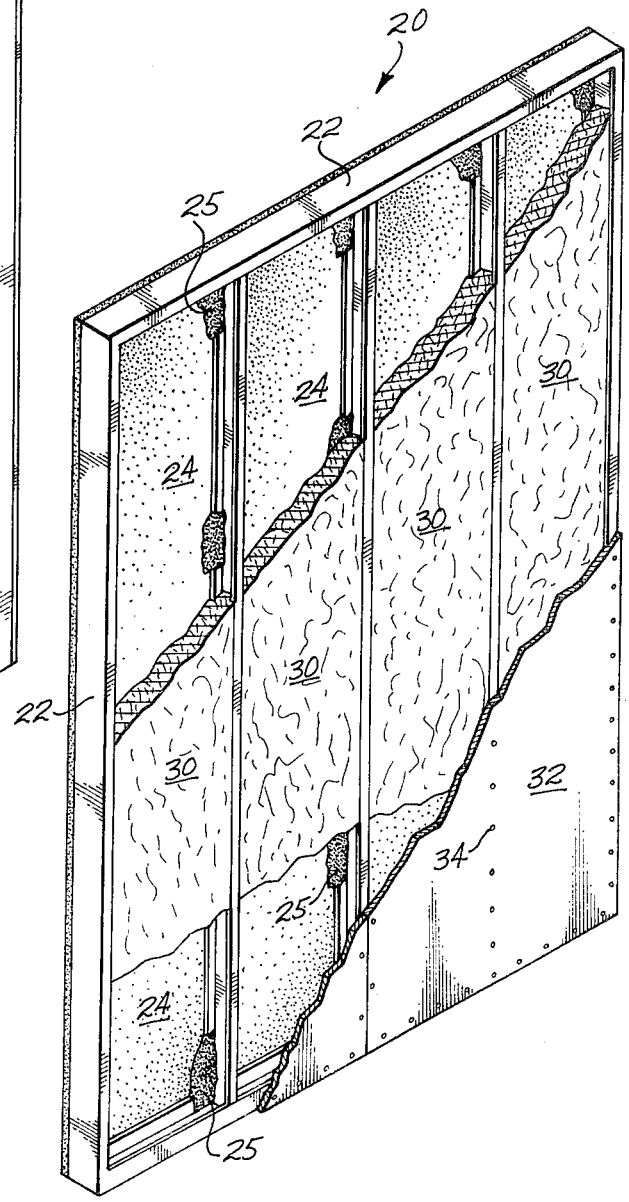
Fig. 2

Fig. 6
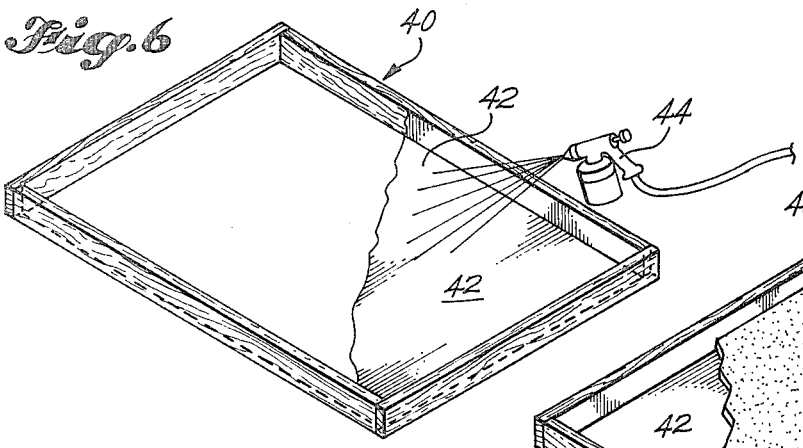
Fig. 7
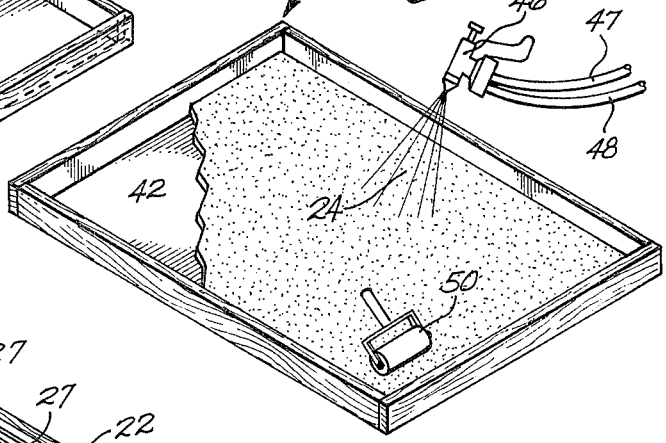
Fig. 8
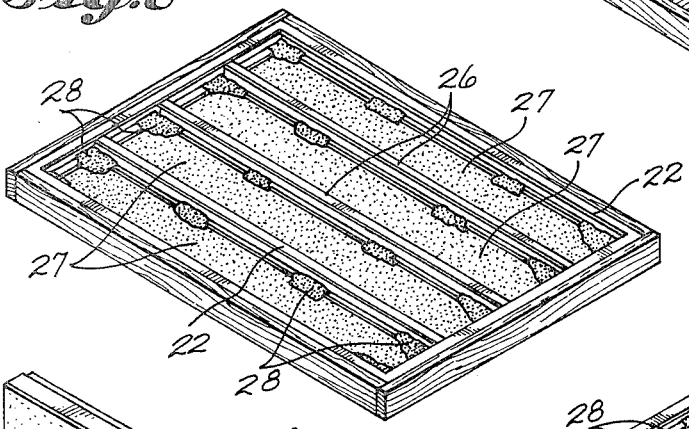
Fig. 9
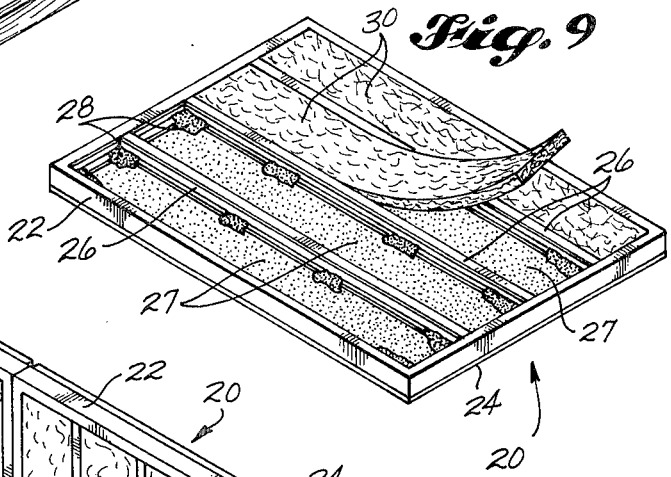
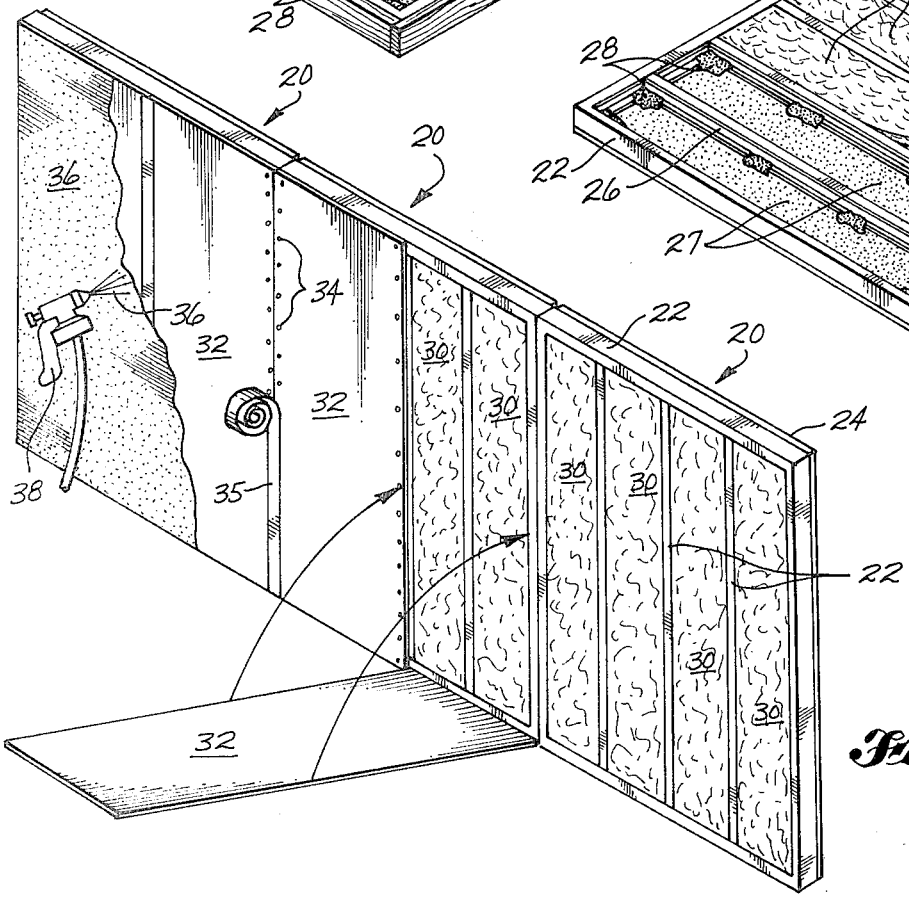
Fig. 10

BUILDING WALL PANEL AND METHOD OF MAKING SAME

FIELD OF INVENTION

The present invention relates in general to the building wall panel art, and more particularly to the art of manufacturing and mounting on buildings, a wall panel having an exterior facing formed from a glass fiber reinforced concrete.

BACKGROUND ART

A long felt need in the building wall panel field has been a prefabricated wall panel having either a finished exterior facing adapted for use as an exterior load bearing or non-load bearing wall on commercial buildings, such as multistory apartments or the like, or a wall panel having both major surfaces finished and adapted for use as an interior load bearing wall or non-load bearing partition for such buildings. The fire codes for many commercial buildings prohibit the use of flame transmitting materials in the construction of exterior and interior wall panels, consequently any wall panel adapted for such use must be fabricated from non-flammable material to conform to these codes. In addition to having the above qualities, the ideal wall panel should be capable of being prefabricated as large multistory or multibay panels to minimize on-site construction time. This of necessity requires that the panels have sufficient strength such that they may span relatively large distances, typically twenty feet, without the need of expensive and heavy supporting structures attached to the buildings.

A wall panel having finished surfaces on both sides is shown by Balduf, U.S. Pat. No. 2,241,338. Balduf discloses a structure having a facing of plasterboard or gypsum board secured to one side of a frame formed from a plurality of metal studs. A relatively thin layer of plaster overlays the plasterboard on both sides of the frame. The structure as disclosed by Baldulf is not well adapted to prefabrication since the plasterboard is attached to the metal frame after the metal frame is secured within a building. In addition, the thin layer of plaster overlaying the plasterboard is affixed to the plasterboard after the partition is placed within the structure, thereby requiring time consuming, onsite fabrication to produce the finished partition. The Balduf partition is also not well adapted for exposure to an external environment. The relatively thin layer of plaster is easily cracked when exposed to high tensil and twisting forces such as are encountered on the exterior surface of a building. When exposed to normal weather cycles, the layer of plaster may easily separate from the underlying plasterboard.

Another wall panel, shown by Martin, U.S. Pat. No. 3,885,008, has an external molded panel bonded to a frame constructed from wood. The external molded panel is formed from a plastic compound and is bonded to the wooden frame by overlaying the entire back surface of the molded panel and the sides of the adjacent frame members with a layer of fiberglass reinforced plastic. This wall panel has inherent structural as well as durability limitations. For example, the attachment of a rigid plastic produces a wall panel with an external surface subject to cracking and separation from the underlying wooden frame when exposed to the tensil and twisting forces occurring in a multistory structure. In addition, the inherent structural weakness of the underlying wooden frame generally prohibits prefabricating such a wall panel into a single large multistory panel. Since the plastic exterior molded panel, the bonding compound securing the molded panel to the wooden frame, and the wooden frame itself, are all flammable materials, the panel as disclosed by Martin would not satisfy the fire codes for commercial structures. If the wooden frame of Martin were replaced by a metal frame, Martin would then have a problem of bonding the rigid external plastic molded panel to a frame having more flexure than the wooden frame. In such a situation, when the frame flexed, the bonding would likely break, resulting in the separation of the molded panel from the frame. In addition, the underlying metal frame generally would weigh more than the relatively thin molded panel thereby contributing to the cracking or breaking of the external molded panel.

The present invention overcomes these problems of the prior art by providing a building wall panel having an exterior facing formed from a glass fiber reinforced concrete bonded to a metal frame, formed from a plurality of vertical members, at intervals along the length of the vertical members. The bonding is provided by a glass fiber reinforced concrete similar to that used in forming the exterior facing. The use of a glass fiber reinforced exterior facing provides a building wall panel which is particularly well adapted for exposure to an external environment since such a facing has wear characteristics similar to those of concrete. The use of the metal frame as the supporting structure for such an exterior facing provides a wall panel having high tensil strength and one which can span large distances without the need of expensive support members affixed to the structure. Bonding the exterior facing to the metal vertical members at intervals along the length of each member provides a building wall panel which is particularly well adapted for prefabrication. The building wall panel employs materials which are neither flammable nor exhibit flame transmitting characteristics and thus the wall panel of the present invention conforms to the fire codes required for commercial structures. If the building wall panel of the present invention conforms to the fire codes required for commercial structures. If the building wall panel of the present invention is to be used as an interior wall or partition, a layer of gypsum board, dry wall, or the like may be easily and quickly attached to one side of the frame, such as by the use of self-tapping screws or the like and covered with a plaster faced tape producing a prefabricated wall panel having both surfaces finished. In situations where required, a layer of insulation may be easily attached to the wall panel between adjacent vertical members prior to attaching the layer of gypsum board.

DISCLOSURE OF THE INVENTION

According to one aspect of the present invention, a building wall panel is provided comprising a generally rectangular metal support frame formed from a plurality of vertical members each having a plurality of flanges on at least one side thereof extending outwardly from the edges along the length of the member. A thin, exterior facing formed from glass fiber reinforced concrete is disposed across one side of the support frame and abuts a flange on each vertical member. A layer of glass fiber reinforced concrete overlays a portion of the rear surface of the exterior facing and the flange abutting the rear surface at intervals along the length of the vertical member, thereby bonding the exterior facing to the metal support frame.

According to another aspect of the present invention, a method of forming a building wall panel having an external facing formed from glass fiber reinforced concrete is disclosed comprising the steps of: fabricating a metal support frame from a plurality of vertical members each having a plurality of flanges disposed on at least one side thereof extending outwardly from the edges along the length of the vertical member; constructing a generally rectangularly shaped building wall panel mold from a plurality of elongate and smooth sided members detachably secured to each other and removably secured to a flat, smooth surface; spraying a first layer of slurry formed from a mixture of concrete and randomly oriented chopped glass fiber strands on the surface within the elongate members forming the mold in a layer having a substantially uniform thickness; placing the metal support frame over the first layer of slurry such that a flange on each vertical member abuts the first layer of slurry; spraying a second layer of slurry over a portion of the first layer of slurry and the flange abutting the first layer along the length of each vertical member; curing both layers of slurry and removing the completed building wall panel from the surface and the building wall panel mold.

BRIEF DESCRIPTION OF THE DRAWINGS

FIG. 1 is a front perspective view of one embodiment of a typical building wall panel made according to the present invention with portions shown cut away for the sake of clarity.

FIG. 2 is a rear perspective view of one embodiment of a typical building wall panel made according to the present invention with portions shown cut away for the sake of clarity.

FIG. 6 is a pictorial representation showing the steps of forming the wall panel mold and applying a layer of bond breaker therein.

FIG. 7 is a pictorial representation showing the steps of spraying a first layer of slurry in the mold and compacting same.

FIG. 8 is a pictorial representation showing the steps of placing the panel support frame within the mold and applying a second layer of slurry thereon.

FIG. 9 is a pictorial representation showing the step of applying insulation to the wall panel.

FIG. 10 is a pictorial representation showing the step of providing the wall panel with a finished interior surface.

BEST MODE OF CARRYING OUT THE INVENTION

Figure 3:
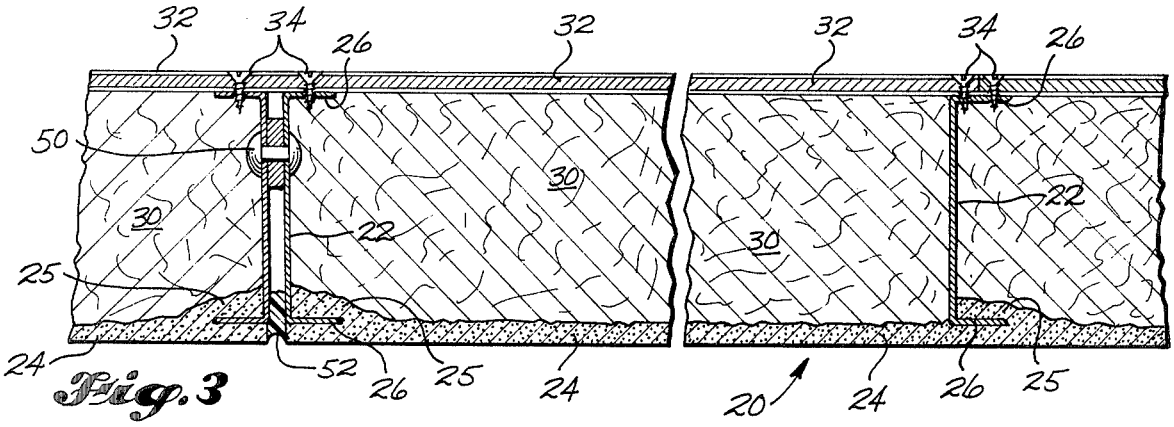
FIG. 3 is a top section view of two typical building wall panels made according to the present invention showing a typical joint therebetween.

In one embodiment of the present invention, as shown in FIGS. 1–4, the building wall panel, shown generally at 20, comprises a plurality of metal vertical members 22 interconnected to form a wall panel frame. A thin exterior facing 24 formed from a first layer of glass fiber reinforced concrete is disposed across one side of the wall panel support frame. A second layer of glass fiber reinforced concrete 25 overlays a portion of the rear surface of the exterior facing and a portion of each vertical member at intervals along the length of each of the vertical members thereby bonding the exterior facing to the frame. Referring particularly to FIG. 3, each metal vertical member 22 forming the wall panel frame is shown to have a plurality of flanges 26 thereon extending outwardly from the edges along the length of each member. The flanges 26 provide a lip or a return means and enable the exterior facing 24 to be bonded to the metal frame. Insulation 30, in the form of strips or the like, may overlay the rear surface of the exterior facing adjacent each vertical members 22 thereby producing a building wall panel adapted for exterior or interior use. Panels of gypsum board, dry wall, or the like, shown at 32, may then overlay the insulation 30 and be secured to each vertical member 22, such as by the use of self tapping screws 34 (see FIG. 3) or the like covered with a layer of plaster backed tape 35 (see FIG. 10) to provide a wall panel having both surfaces finished. If desired, a conventional texturized material 36 may overlay the entire rear surface (see FIG. 10) of the wall panel.

Figure 5:
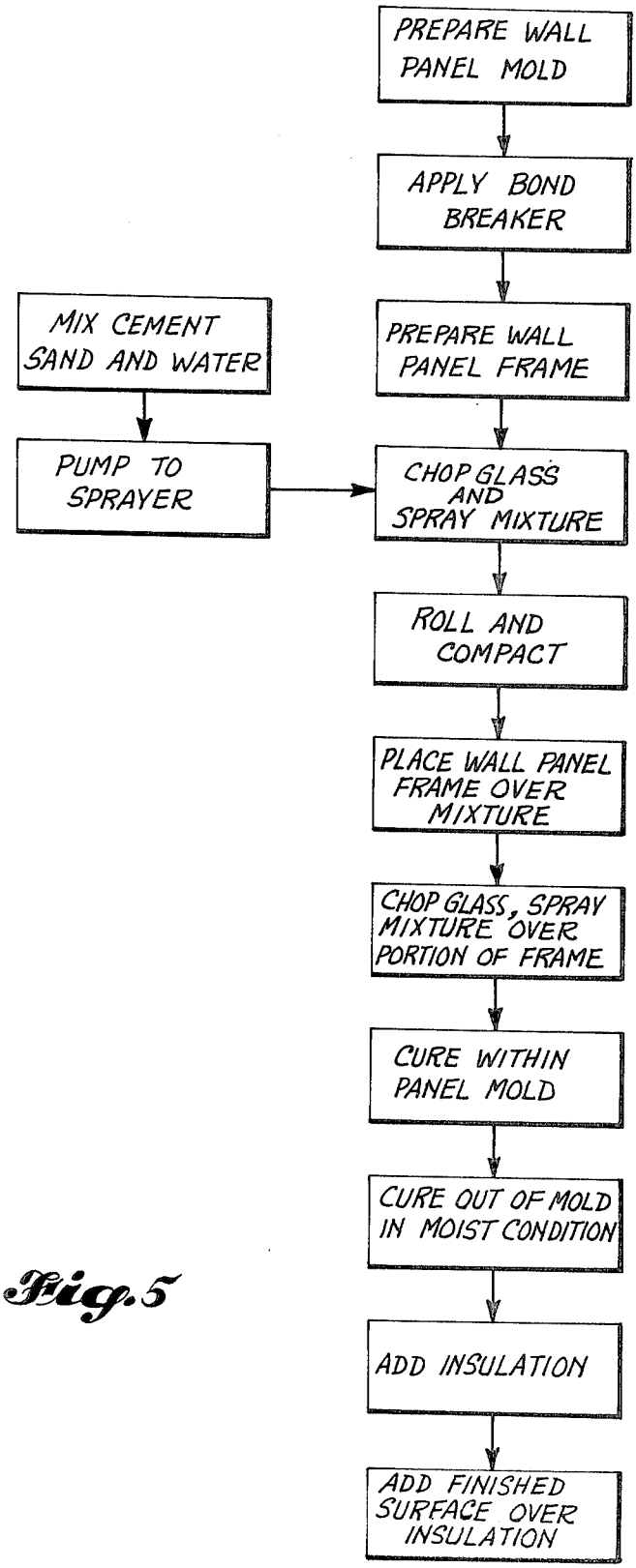
FIG. 5 is a flow diagram illustrating one typical sequence of steps of forming a building wall panel in accordance with the present invention.

Referring now to the flow chart of FIG. 5, and the associated FIGS. 6–10, one method of forming a building wall panel in accordance with the present invention will next be described.

The building wall panel mold, shown generally at 40, is constructed to the shape of the desired finished building wall panel. Each member of the wall panel mold 40 is detachably secured to the other members comprising the mold, and removably secured to a flat, smooth surface. The wall panel mold 40 is constructed from elongate members having generally smooth sides and from any suitable material such as wood, metal, or the like. The size of the wall panel mold 40 depends upon the desired size of the finished wall panel 20. In general, the panel mold is slightly longer and slightly wider than the wall panel metal frame to enable the metal frame to be snugly inserted within the mold during fabrication of the wall panel, as will be discussed. The means for detachably securing the panel mold members to each other, and for removably securing the panel mold 40 to the smooth surface, such as nails, are old per se and are not part of the present invention. Although FIG. 6 shows a wall panel mold 40 having a generally rectangular shape, it will be understood that other building wall panel shapes and corresponding wall panel molds also may be used in the practice of the present invention.

As shown in FIG. 6, a layer of bond breaker 42 is applied to the surface between the elongate members forming the building wall panel mold 40 and to the members forming the wall panel mold by means of a spray gun 44 or the like. The layer of bond breaker 42 facilitates removal of the completed building wall panel 20 from both the smooth surface and from the wall panel mold 40. The bond breaker as well as the spray gun are old per se.

A building wall panel frame is next constructed from a plurality of metal vertical members 22. Each vertical member has a plurality of flanges 26 on at least one edge thereof extending outwardly from the edges of the member along the length thereof. The frame is constructed such that the flanges 26 are arranged in a plane adapted to abut the rear surface of the exterior facing, and permit bonding the exterior facing 24 to the vertical members forming the frame. In the preferred embodiment, the plurality of vertical members 22 are typically metal studs having a width of four inches but it is to be understood that it is possible to use studs formed of other materials and widths without departing from the spirit and scope of the present invention. In the preferred embodiment, the vertical members 22 are typically the height of one building story (normally twelve feet) but other lengths may be used as desired. Vertical members 22 are rigidly secured to each other by welding or the like and are disposed adjacent each other typically on sixteen inch centers to facilitate securing standard sized interior gypsum boards or the like thereto. It is to be understood that depending upon the use of the wall panel, vertical members may be disposed adjacent each other at other than sixteen inch centers without departing from the scope of the present invention.

A mixture of concrete is then prepared using cement, sand, and water. In the present preferred embodiment, one hundred pounds of cement is mixed with thirty pounds of sand and enough water, approximately forty pounds, to make a flowable mix. It is to be understood that the weight of sand in the concrete mix can be varied from near zero to a weight equal to that of the cement without departing from the spirit and scope of the present invention. The cement, sand, and water are mixed in a conventional concrete mixer (not shown) and pumpted to a sprayer 46 through a line 47 (see FIG. 7). Compressed air is furnished to the sprayer through hose 48. A substantially continuous strand of alkali resistant glass fiber is also run to a conventional chopper mechanism (not illustrated) associated with the sprayer 46 from a roll or the like. The glass fiber is chopped into a plurality of short segments and mixed with the concrete in a known manner to form a slurry of concrete and chopped glass fiber strands. The percentage of chopped glass fiber in the slurry may be varied in the range of from two to six percent of the weight of the concrete as desired to meet the strength needs of the building wall panel. The length of the chopped glass fibers also may be varied, but it has found that a length of about one and one half inches is satisfactory for most uses. One type of glass fiber which has been found to be satisfactory is marketed under the name CEM-FIL alkali resistant glass fiber by CEM-FIL Corporation of Nashville, Tenn. The chopped glass fiber strands have a random orientation with respect to each other when they are mixed with concrete.

A first layer of slurry 27 is then sprayed on the smooth surface within the wall panel mold 40. Although the thickness of the first layer of slurry may be varied, it has been found that a satisfactory building wall panel capable of spanning multiple stories may be formed with a thickness of as little as three-eights of one inch, it being understood that the thickness of the slurry may be increased to increase the strength of the building wall panel to meet the needs of a particular application. After the first layer of slurry 27 has been sprayed over the smooth surface, and before the layer has cured, it is compacted, as by use of a roller 50 or the like, to form a layer of slurry having a substantially uniform thickness.

Referring now to FIG. 8, the building wall panel frame is next snugly placed within the panel mold 40 such that the flanges 26 on each vertical member abut the first layer of slurry 27. Before the first layer of slurry has cured, a second layer of slurry, shown at 28, is sprayed over portions of the first layer of slurry and portions of each flange 26 abutting the first layer of slurry, at intervals along the length of each vertical member. The second layer of slurry 28 has a thickness sufficient to completely cover a portion of the flange 26. It has been found that overlaying the flanges 26 with slurry portions having a width of as little as four to six inches at two foot intervals along the length of each member is sufficient to bond the first layer of slurry to the frame.

After the second layer of slurry 28 has been applied over both a portion of the flanges 26 along each vertical member 26 and a portion of the first layer of slurry 27, the building wall panel 20 is allowed to cure in the wall panel mold 40 for a period of approximately twelve hours. After that time, the mold 40 is removed from the smooth surface, the plurality of smooth sided members forming the mold 40 are detached from each other and from the wall panel, and the building wall panel is allowed to cure for an additional seven days. During this time, the building wall panel is maintained in a moist environment such as by intermittenly spraying the wall panel with water or the like. It is to be understood that the curing times mentioned above are only approximate and may be varied somewhat without departing from the spirit and the scope of the present invention.

If desired, a layer of insulation 30 in the form of bats or a roll or the like may be applied over the rear surface of the cured slurry 27 between adjacent vertical members 22 and secured thereto as by gluing a plurality of pins (not shown) to the back rear surface of the slurry and by securing the insulation thereto by fastener means such as snap-on nuts or the like. Application of the insulation 30 at the factory where the building wall panel 20 is fabricated eliminates the often difficult and time consuming task of applying insulation at the building site after insulation of the wall panel.

Figure 4:
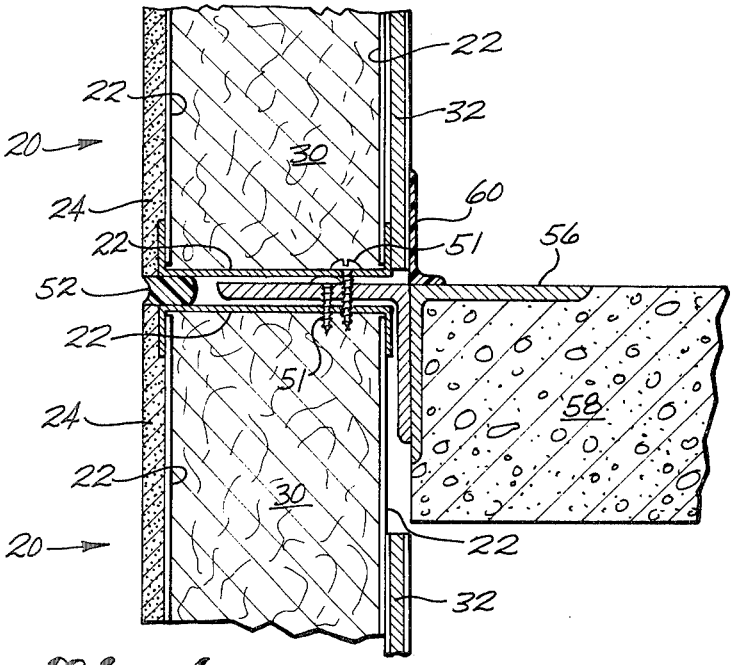
FIG. 4 is a side section view of two typical building wall panels made according to the present invention showing a typical joint between the wall panels and a floor member.

With reference to FIGS. 3 and 4, completed building wall panels 20 are secured to the exterior or interior of a structure such as by use of rivets, bolts or other conventional fasteners applied at the top and bottom ends of the building wall panel. Adjacent wall panels may be secured to each other by means of rivets 50, bolts 51 or the like, extending through abutting elongate members 22. A layer of caulking compound 52 or the like is applied between adjacent wall panels 20 to seal the panel joints and prevent moisture from reaching the rivet 50. In situations where it is necessary to secure a plurality of building wall panels together to form an exterior wall having a finished interior surface (see FIG. 4), such as between adjacent floors in a multistory structure, the lower wall panel is first secured to the lower floor member such as by rivets. Bolts or the like. The upper floor member 58, typically having a plurality of metal flanges 56, 57 secured at each edge thereon is secured to the lower wall panel in a similar manner. The upper wall panel is then secured to the flanges 56, 57 and the lower wall panel. A trim piece 60 may then be added at the edge formed by the floor member 58 and upper wall panel. Other methods to secure a plurality of building wall panels to an adjacent floor may be used to practice the invention, such as by welding an angle member to the upper wall panel and providing the floor member 58 with a pocket to engage and secure the angle member.

With reference to FIG. 10, if it is desired to provide a wall panel having both major surfaces finished, a panel 32 of gypsum board or dry wall or the like, may be applied to the surface to each vertical member 22 by means of a plurality of self tapping screws 34 or the like. If self tapping screws are used, a thin layer of plaster backed tape 35 is applied at the edges between adjacent sheets of gypsum board 32, as well as over each row of the self tapping screws to form a wall panel 20 having a finished exterior as well as interior surface. If desired, a final layer of interior facing material 36 such as a texturized plaster, paint or the like may be applied over the gypsum board 32 as by means of sprayer or the like.

INDUSTRIAL APPLICABILITY

The present invention has applicability in any situation where it is necessary to provide a structure with a prefabricated building wall panel adapted for exterior as well as interior use.

I claim:

1. A building wall panel comprising:

(a) a wall panel support frame formed from a plurality of metal vertical members each having a flange on at least one side thereof extending outwardly from the edges along the length of said member;

(b) a thin exterior facing formed from glass fiber reinforced concrete disposed across one side of said wall panel support frame and abutting a flange on each of said vertical members; and, (c) a layer of glass fiber reinforced concrete overlaying a portion of the rear surface of said exterior facing and at least a portion of said flange abutting said exterior facing at intervals along the length of each of said vertical members, said layer bonding said exterior facing to said wall panel support frame.

2. The building wall panel of claim 1 wherein said glass fiber reinforced concrete comprises a mixture of concrete and randomly oriented chopped strands of glass fiber.

3. The building wall panel of claim 2 wherein the chopped strands of glass fiber are alkali resistant.

4. The building wall panel of claim 2 wherein the shopped strands of glass fiber are approximately one and one half inches in length.

5. The building wall panel of claim 2 wherein the glass fibers comprise from between two to six percent of the weight of said concrete.

6. The building wall panel of claim 1 wherein said exterior facing has a thickness of approximately three-eights of one inch.

7. The building wall panel of claim 1 further including a layer of insulation overlaying the rear surface of said exterior facing between adjacent vertical members of said metal wall panel support frame.

8. A building wall panel having a relatively thin exterior facing formed from concrete and randomly oriented chopped glass fiber strands overlaying a metal wall panel support frame formed from a plurality of channel members and bonded thereto by a layer of concrete and randomly oriented chopped glass fiber strands overlaying portions of the rear surface of said exterior facing and at least a portion of each of said channel members.

9. The building wall panel of claim 8 wherein said exterior facing has a thickness of approximately three-eights of one inch.

10. A method of forming an improved building wall panel comprising the steps of:

(a) interconnecting a plurality of metal vertical members to form a generally rectangular wall panel support frame wherein each vertical member has a longitudinal flange on at least one side thereof extending outwardly from its edges;

(b) interconnecting a plurality of elongate smooth sided members to form a generally rectangular building wall panel mold wherein each member is detachable from the other members;

(c) securing to a flat, smooth surface said building wall panel mold;

(d) forming a slurry of concrete and randomly oriented chopped glass fiber strands;

(e) spraying a first layer of slurry on said surface between said members forming said wall panel mold to a substantially uniform thickness.

(f) placing said wall panel support frame on said first layer of slurry such that a flange of each of said vertical members abuts said first layer of slurry.

(g) spraying a second layer of slurry over a portion of said first layer of slurry and over at least a portion of each of said flanges abutting said first layer of slurry along the length of each of said vertical members;

(h) curing said first and said second layers of slurry and removing the completed building wall panel from said surface and said mold.

11. The method of claim 10 wherein the step of forming said slurry comprises mixing said randomly oriented glass fiber strand with said concrete such that the weight of said strands are equal to between two percent and six percent the weight of said concrete.

12. The method of claim 10 further including the steps of rolling and compacting said first layer of slurry on said surface within said mold after spraying therein.

13. The method of claim 10 wherein the step of forming said slurry comprises mixing said concrete with randomly oriented chopped glass fiber stands that are alkali resistant.

14. A method of mounting a building wall panel having a relatively thin exterior facing formed from concrete and chopped glass fiber strands on a building comprising the steps of:

(a) forming a slurry of concrete and randomly oriented chopped glass fiber strands;

(b) spraying a first layer of slurry within a building wall panel mold to a substantially uniform thickness;

(c) placing a wall panel support frame formed from a plurality of channel members on said first layer of slurry.

(d) spraying a second layer of slurry over both a portion of said channel members abutting said first layer of slurry and over a portion of said first layer of slurry at intervals along the length of said channel members; and, (e) connecting said wall panel support frame to a building to clad said building.

15. A method of forming an improved building wall panel having a relatively thin exterior facing formed from concrete and chopped glass fiber strands comprising the steps of:

(a) forming a slurry of concrete and randomly oriented chopped glass fiber strands;

(b) spraying a first layer of slurry within a building wall panel mold to a substantially uniform thickness;

(c) placing a wall panel support frame formed from a plurality of channel members on said first layer of slurry;

(d) spraying a second layer of slurry over both a portion of said channel members on said first layer of slurry and over a portion of said first layer of slurry at intervals along the length of said channel members;

(e) curing said first and said second layers of slurry and removing the completed building wall panel from said mold.

* * * * *

UNITED STATES PATENT OFFICE

CERTIFICATE OF CORRECTION

Patent No. 4,185,437 Dated January 29, 1980

Inventor(s) Ralph C. Robinson

It is certified that error appears in the above-identified patent and that said Letters Patent are hereby corrected as shown below:

Column 2, line 42, cancel beginning with "If the" to and including "commercial structures." in column 2, line 44.

Column 5, line 30, delete "pumpted" and replace with - - pumped - - .

Claim 4, line 41, delete "shopped" and replace with - - chopped - - .

Signed and Sealed this

*Sixth* Day of *May 1980*

[SEAL]

*Attest:*

SIDNEY A. DIAMOND

*Attesting Officer*

*Commissioner of Patents and Trademarks*